United States Patent [19]

Mironenko et al.

[11] Patent Number: 4,559,422

[45] Date of Patent: Dec. 17, 1985

[54] MICROSWITCH

[76] Inventors: Vyacheslav G. Mironenko, ulitsa Stromynka, 11, korpus 2 kv. 120, Moscow; Alexandr P. Poltorak, ulitsa Schorsa, 25, kv. 1, Donetsk; Vitaly I. Schutsky, ulitsa Profsojuznaya, 75, korpus 1, kv. 34, Moscow; Vladimir A. Kosovtsev, prospekt Traktorostroitelei, 77, kv. 335, Kharkov; Fedor P. Chaly, prospekt Traktorostroitelei, 158, kv. 120, Kharkov; Vladislav F. Zagubeljuk, ulitsa Georev truda, 47, kv. 45, Kharkov; Nikolai I. Filatov, ulitsa Sovetskaya, 6, Kizlyar, poselok Komsomolsky, Dagestanskaya; Vadim V. Emelyanenko, bulvar Shevchenko, 125 kv. 20, Donetsk; Valentin V. Morgunov, prospekt Dzerzhinskogo 53, kv. 51, Donetsk; Eduard S. Rozental, ulitsa Kirova, 32, kv. 10, Moscow; Vladimir I. Litvinov, bulvar, Shevchenko, 69 kv. 4, Donetsk, all of U.S.S.R.

[21] Appl. No.: 598,352

[22] PCT Filed: Jun. 21, 1982

[86] PCT No.: PCT/SU82/00019

§ 371 Date: Feb. 13, 1984

§ 102(e) Date: Feb. 13, 1984

[87] PCT Pub. No.: WO84/00248

PCT Pub. Date: Jan. 19, 1984

[51] Int. Cl.[4] ..... H01H 21/44

[52] U.S. Cl. ..... 200/67 D; 200/67 E; 200/244

[58] Field of Search ..... 200/67 R, 67 B, 67 D, 200/67 E, 67 A, 67 C, 67 PK, 244

[56] References Cited

U.S. PATENT DOCUMENTS

| | | | |
|---|---|---|---|
| 2,601,152 | 6/1952 | Kmieck | 200/67 D |
| 2,821,588 | 1/1958 | Fisher | 200/153 R |
| 2,929,891 | 3/1960 | Tyler | 200/164 R |
| 2,975,249 | 3/1961 | Friend | 200/67 R |

FOREIGN PATENT DOCUMENTS

| | | | |
|---|---|---|---|
| 1389919 | 4/1975 | United Kingdom | 200/67 R |
| 1521222 | 8/1978 | United Kingdom | 200/67 R |

*Primary Examiner*—Stephen Marcus
*Assistant Examiner*—Renee S. Kidorf
*Attorney, Agent, or Firm*—Lilling & Greenspan

[57] ABSTRACT

A microswitch comprises an insulating base, fixed contacts secured on the insulating base (1), a movable contact (4) adapted for selectively engaging the fixed contacts (2, 3) an actuating member (5), and means for shifting the movable contact (14) by the use of the actuating member (5). The means for shifting the movable contact (4) includes an actuating lever (6), an intermediate lever (7) a flat spring (8), and a contact lever (9) all connected in series with one another, the actuating and the contact levers (6 and 9) being pivotally connected to the insulating base (1), the ends of the intermediate lever (7) and of the flat spring (8) being connected with one another a bearing up against a limit stop (17), and the contact lever (9) having a free end (12) whereon the movable contact (4) is located. The flat spring (8) is connected with the end (16) of the contact lever (9) opposite to the free end thereof on which the limit stop (17) and the movable contact (4) are located, and the contact lever (9) is connected with the insulating base (1) at the middle portion thereof between the movable contact (4) and the point of connection of the ends (16 and 15) of the contact levers (9) and the flat spring (8).

1 Claim, 12 Drawing Figures

MICROSWITCH

BACKGROUND OF THE INVENTION

1. Technical Field

The present invention relates to electrical switches, and more particularly, it concerns microswitches.

The invention may be useful as a limit switch in automated control and protection signalling systems in electric drives of machines and mechanisms.

2. Description of the Prior Art

The precision of operation of automatic lines and also control systems for technological processes is much dependent upon the sensitivity of the microswitches employed, which must provide for the precision of transmitted information. It is very difficult in practice to correct the errors made by microswitches.

To actuate movable contacts in microswitches metal plates are preferably used which respond to temperature or pressure and which are subject only to insignificant bending under tension or compression. Therefore, one of the main characteristics of microswitches is sensitivity which is defined by the distance of travel of an actuating member, i.e. by its differential stroke (the shorter the path required for shifting a movable contact in a microswitch the higher its sensitivity).

Known in the art is a microswitch (see, for example, U.S. Pat. No. 2,729,714, Int. Cl²HOIH 13/28) comprising an insulating base 1' (see FIGS. 1,2) fixed contacts 2', 3' secured on this base 1', a movable contact 4' adapted to selectively contact the fixed contacts 2' and 3', and means for shifting the movable contact 4' by the use of an actuating member. The means for shifting the movable contact includes an actuating lever 5' and an intermediate lever 6' connected with one another, a flat spring, and a contact lever 8'. The actuating and the contact lever 5' and 8' are connected by their ends in a single point on the insulating base 1'. The movable contact 4' is mounted on the opposite free end of the contact lever 8' whose middle portion is connected with an end of the flat spring 7'. The other end of the flat spring 7' is connected with an end of the intermediate lever 6' and when in its extreme positions it bears up against a limit stop 9' formed on the insulating base 1'. The other end of the intermediate lever 6' is connected with the end of the actuating lever 5' which is opposite to the end connected to the insulating base 1'.

In the initial position of the microswitch, the preliminarily compressed spring 7' exerts a force P upon the contact lever 8', which is connected with it (see FIG. 1).

The contact pressure is equal to:

$$P_k = P \sin \beta,$$

where $\beta$ is an angle of inclination between the intermediate lever 6' and the spring 7'.

The actuating lever 5' moves under the action of an external force F, and the intermediate lever 6' changes its position with respect to the spring 7'.

As the actuating lever 5' moves to the position of operation (when point A takes position $A_1$), the spring 7' compresses, the force P increase till the value $P_1$, and the contact pressure $P_k$ somewhat increases to $P_{k1} = P_1 \sin \beta$ (FIG. 2).

As the point A crosses the line of the unstable position of the spring 7', line I—I, shifting the contacts 4' takes place at the inherent speed of motion.

With further motion of the actuating lever 5', point A reaches the final position $A_2$ (FIG. 1).

When the external force F is removed from the actuating lever 5', all the levers of the means for shifting the movable contacts 4' tend to return to their initial position.

When the point A of the actuating lever 5' crosses the line II—II, the line of the unstable switched position of the spring 7', i.e. when the point A reaches the position of $A_3$, the reversal shift of the movable contacts 4' takes place.

As can be seen from the description, the contact pressure in the microswitch does not decrease below the nominal value and even slightly increases with the motion of the actuating lever 5' to the position of actuation.

To provide for shifting the contacts 4' in such microswitch, the surfaces defining the motion of the intermediate lever in the limit stop 9' must be located beyond the area defined by the lines of the position of the contact lever 8' in the initial and in the shifted positions.

To provide the shortest differential stroke of the actuating lever 5' that is possible in such microswitch, the spring 7' must be fixed in the middle portion of the contact lever 8', and the limit stop 9' must be located as close to the movable contacts 4' as possible.

The differential stroke of the actuating lever 5' in the point A is equal to:

$$L_A = H + 2\Delta h,$$

where

H = distance between the shifted positions of the movable contact 4' h = magnitude of the stroke of the actuating lever 5'.

The value of the stroke, $\Delta h$, of the actuating lever 5' is calculated from the relation:

$$\frac{\Delta h}{\Delta L} = \frac{\frac{H}{2} + \frac{H}{4}}{L},$$

then $$L_A = \frac{H}{2} + \frac{3}{2} \frac{H\Delta L}{L},$$

where

L is a horizontal projection of the distance from the axis passing through the contacts 2', 3', to the point O of connection of the spring 7' with the contact lever 8'

$\Delta L$ is a horizontal projection of the displacement of the point A from the point O of the connection of the spring 7' with the contact lever 8' required to insure the instantaneous shift of the contacts 4'.

The differential stroke of the actuating lever 5' in the point of application of the force F is equal to:

$$L_F = \left(\frac{H}{2} + \frac{3}{2} \cdot \frac{H\Delta L}{L}\right) \frac{L_2}{L_1}, \quad (1)$$

where $L_1$, $L_2$ are horizontal projections of the length of the actuating lever $5^1$ and of its portion from the point of the force F application to the point $O_1$ of its connection with the insulating base 1'.

Another embodiment of the microswitch disclosed in the same U.S. Pat. No. 2,729,714 also comprises an insulating base 1'' (FIG. 3), fixed contacts 2'', 3'' secured on the insulating base 1'', a movable contact 4'' adapted to selectively engage the fixed contacts 2'', 3'' and means for shifting the movable contact 4'' by the use of an actuating member, which means includes actuating and intermediate levers 5'', 6'' connected in series with one another, a flat spring 7'', and a contact lever 8'', and also a limit stop 9'' formed on the insulating base 1'' and located beyond the area defined by the lines of the positions of the contact lever 8'' in the initial and the shifted positions. However, in this microswitch, the flat spring 7'' is connected not with the middle portion of the contact lever 8'' as it was in the previous microswitch but with the end of the contact lever 8'' on which the movable contact 4'' is mounted. The length of the contact lever 8'' is equal to $L_2+\Delta L$, and the differential stroke of the actuating lever 5'' at the point A and at the point of application of force F is equal to $$L_A = H + \frac{3H\Delta L}{L} \tag{2}$$

$$L_F = \left(H + \frac{3H\Delta L}{L}\right)\frac{L_2}{L_1}$$

Known in the art is also a microswitch (see U.S. Pat. No. 2,228,523 Int. Cl²HOIH 13/28) which like the previous microswitches comprises an insulating base 1''', fixed contacts 2''' and 3''' secured to said base, a movable contact 4''', and means for shifting the movable contact 4''', in which an actuating, an intermediate, a spring and a contact levers 5''', 6''', 7''' and 8''', respectively, are connected in series with one another (see FIG. 4).

A limit stop 9''' is located in this microswitch near the axis, $O_1$, of rotation of the actuating and the contact levers 5''', 8'''. The distance, $H_1$, between the surfaces in the limit stop 9''' defining the stroke of the intermediate lever can be short, i.e. shorter than the distance, H, between the contacts 2''', 3''', unlike that in the previous microswitches.

The value of $H_1$ is governed by the angle $\beta$ and by the rate of the spring 7''' (i.e. by the value of P), which define the contact pressure since $P_k=P_2 \text{ Sin } \beta_1$.

The differential stroke of the actuating lever 5''' at the point A is equal to:

$$L_A=H+2\Delta h_1.$$

The value of $\Delta h_1$ is found from the relation:

$$\frac{\Delta h_1}{\Delta L} = \frac{H_1 + \frac{H - H_1}{2}}{L}$$

Hence $$\Delta h_1 = \frac{(H + H_1)\cdot\Delta L}{2L}$$

Thus $$L_A = H + \frac{(H + H_1)\cdot\Delta L}{L}$$

The differential stroke of the actuating lever 5''' at the point of application of force F is equal to $$L_F = \left[H + \frac{(H + H_1)\cdot\Delta L}{L}\right]\frac{L_2}{L} \tag{3}$$

As can be seen from comparison of the forms (2), (3), the differential stroke of the actuating lever 5''' in this microswitch shown in FIG. 4 is somewhat smaller than in the previous one shown in FIG. 3 since $H+H_1 \leqq 3H$.

$$H_1 \approx \frac{H}{2}, \text{ hence } \frac{3}{2}H << 3H$$

In the known microswitches shown in FIGS. 1–4 the differential stroke of the actuating lever at the point A is considerable, which reduces their sensitivity.

SUMMARY OF THE INVENTION

The invention is directed to the provision of a microswitch wherein the arrangement of components in a means for shifting movable contacts would allow the differential stroke of an actuaing link to be considerably decreased at a constant contact pressure, thus considerably increasing the sensitivity of a microswitch.

Therefore in a microswitch comprising an insulating base, fixed contacts secured on the insulating base, a movable contact for selectively engaging the fixed contacts, an actuating member, and means for shifting the movable contact by the use of the actuating member, which means including an actuating lever, an intermediate lever, a flat spring, and a contact lever all connected in series with one another, the actuating lever and the contact lever being pivotally connected to the insulating base, the ends of the intermediate lever and of the flat spring being connected with one another and bearing against a limit stop, and the contact lever having a free end whereon the movable contact is located, according to the invention, the flat spring is connected with the end of the contact lever opposite to the free end thereof on which the limit stop and the movable contact are located, and the contact lever is connected with the insulating base at the middle portion thereof between the movable contact and the point of connection of the ends of the contact lever and flat spring.

The combination of the flat spring with the contact lever, and of the contact lever with the insulating base, and location of the limit stop on the contact lever allow the differential stroke of the actuating link to be considerably decreased and the sensitivity of the microswitch to be significantly increased.

BRIEF DESCRIPTIVE OF THE DRAWINGS

The invention will now be explained with reference to embodiments thereof which are represented in the accompanying drawings, wherein.

DESCRIPTION OF THE PREFERRED EMBODIMENTS

Figure 1:
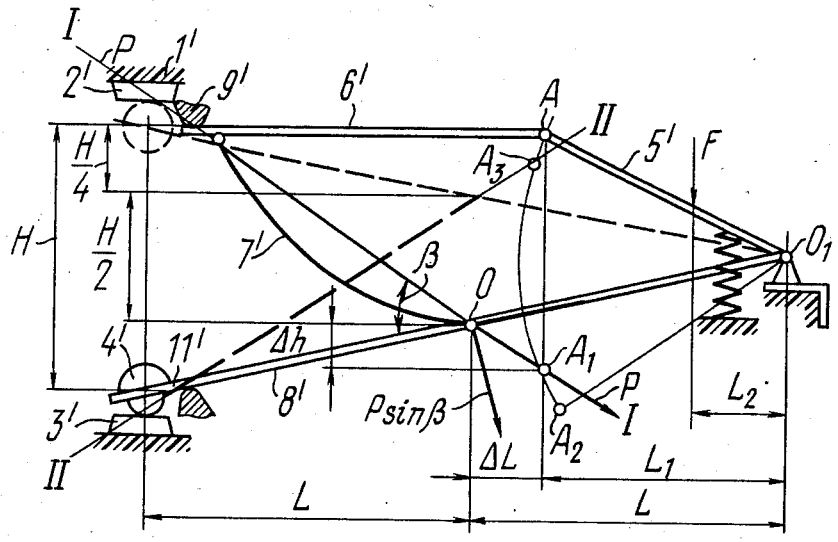
FIG. 1 PRIOR ART
FIGS. 1, 2 show a mechanical diagram of a prior art microswitch in two extreme positions of an actuating lever.
Figure 2:
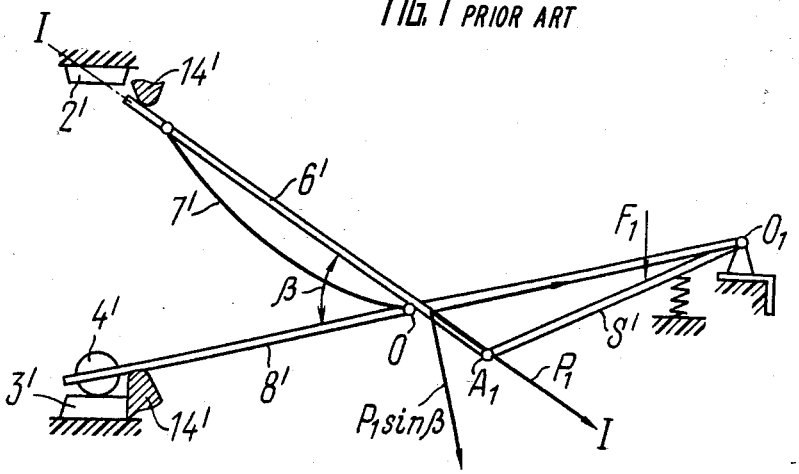
FIG. 2 PRIOR ART
Figure 3:
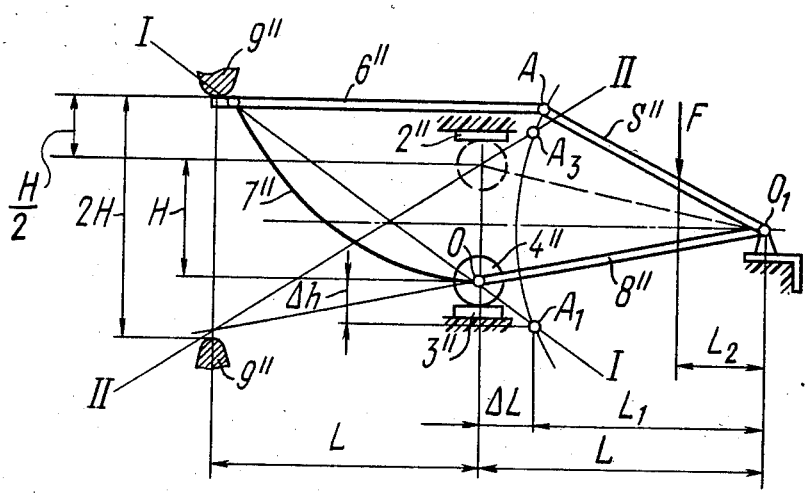
FIG. 3 PRIOR ART
FIG. 3 shows a mechanical diagram of another prior art microswitch.

Referring to FIGS. 5–12, a microswitch comprises an insulating base 1, fixed contacts 2, 3 secured on this insulating base 1, a movable contact 4 adapted for selectively engaging the fixed contacts 2, 3, an actuating member 5, and means for shifting the movable contact 4 by the use of the actuating member 5.

The means for shifting the movable contacts 4 includes an actuating lever 6, an intermediate lever 7, a flat spring 8, and a contact lever 9. One end 10 of the actuating lever 6 is pivotally connected to the insulating base 1.

The other end 11 of the actuating lever 6 is connected with the intermediate lever 7. The movable contact 4 is mounted on the free end 12 of the contact lever 9. Ends 13 and 14 of the intermediate lever 7 and of the flat spring, respectively, are connected with each other. The contact lever 9 is pivotally connected to the insulating base and is connected with an end 15 of the flat spring 8.

In accordance with the invention, the end 15 of the flat spring 8 is connected with the end 16 of the contact lever 9 which is opposite to the end on which the movable contact is located. A limit stop 17 is located on the free end of the contact lever 9, which limit stop restricts the motion of the end 13 of the intermediate lever 7. The contact lever 9 is connected with the insulating base 1 by its middle portion between the movable portion 4 and the point of connection of the ends 16 and 15 of the contact lever 9 and of the flat spring 7.

Such arrangement allows the differential stroke of the actuating link to be considerably decreased and therefore the sensitivity of the microswitch to be considerably increased in comparison with prior art microswitches.

FIGS. 7–12 illustrate possible modifications of the microswitch of the invention and the arrangement of the levers and the flat spring.

The microswitch operates as follows.

Figure 5:
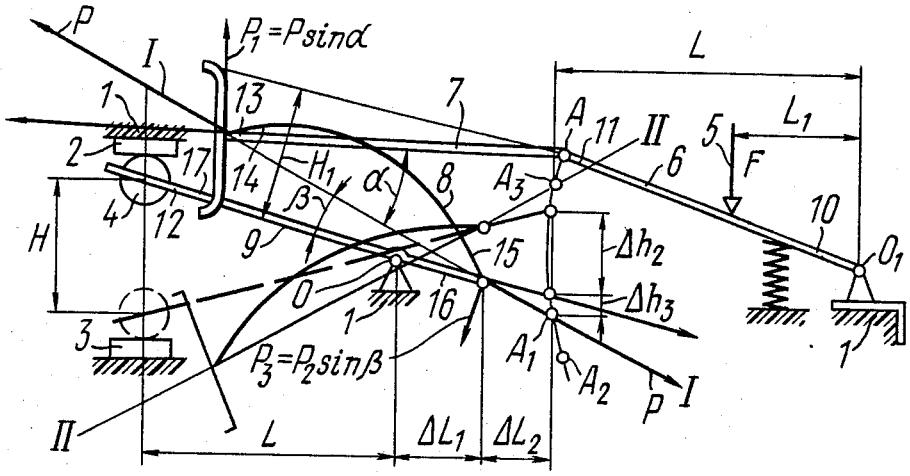
FIGS. 5–6 show a mechanical diagram of a microswitch constructed in accordance with the invention illustrating two extreme positions of the actuating link.
Figure 6:
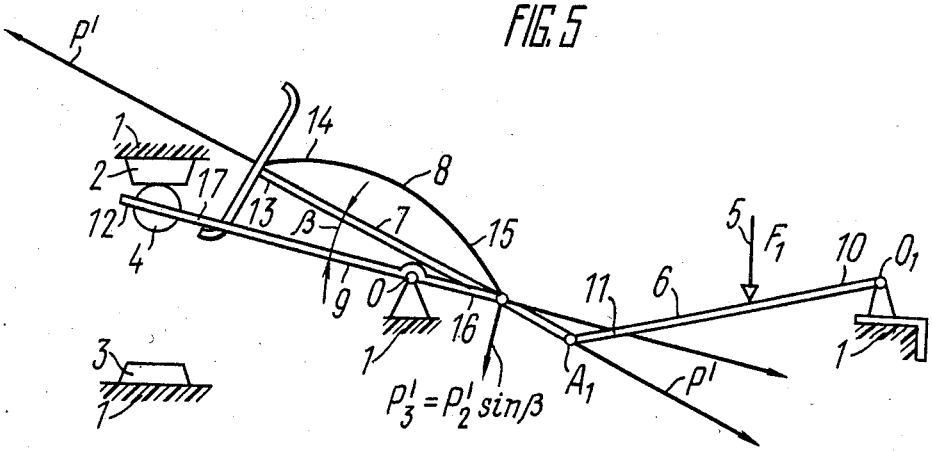
Figure 7:
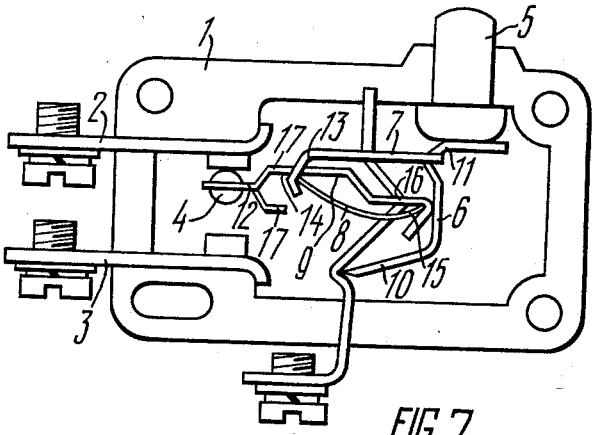
FIG. 7 is a general view showing a modification of the microswitch of the invention.
Figure 8:
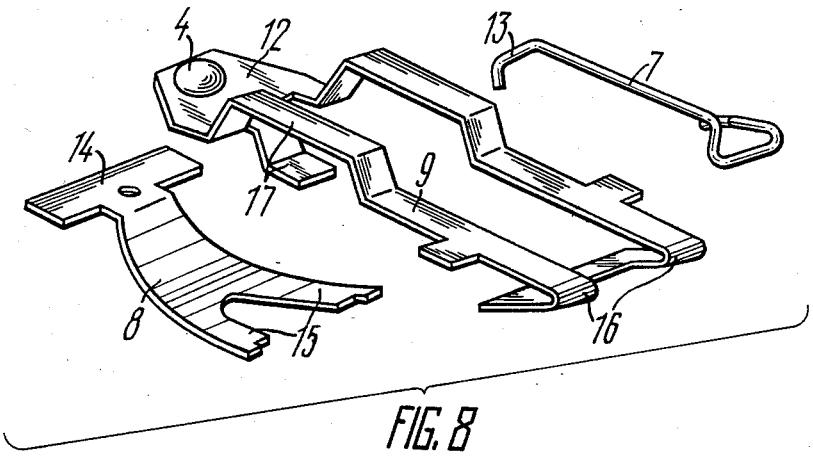
FIG. 8 is an exploded view of the snap blade of the microswitch shown in FIG. 7.
Figure 9:
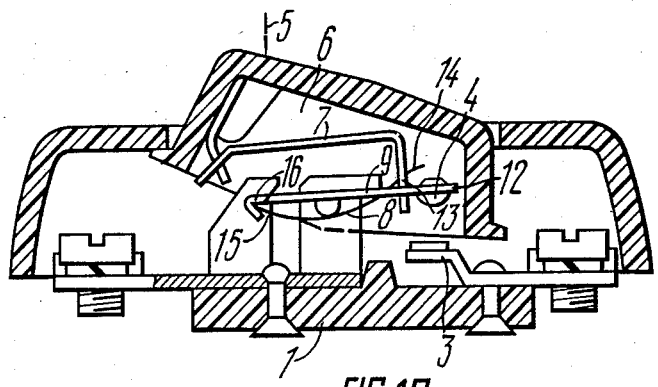
FIG. 9 is a general view showing another modification of the microswitch of the invention.
Figure 10:
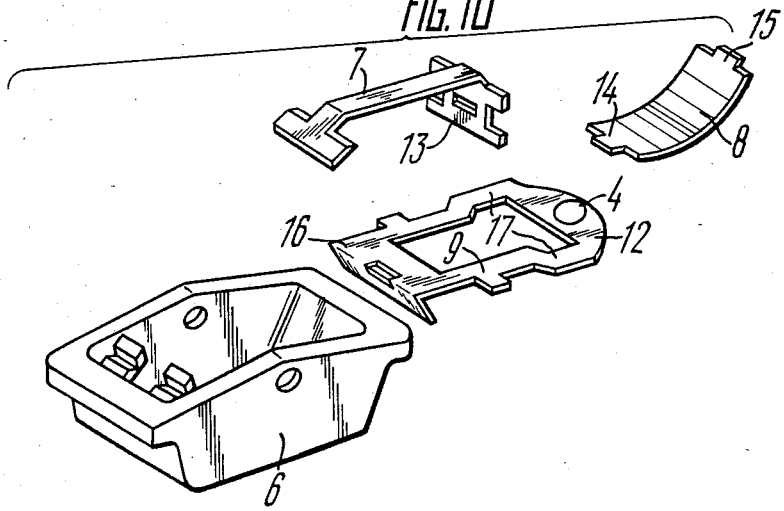
FIG. 10 is an exploded view of the microswitch shown in FIG. 9.
Figure 11:
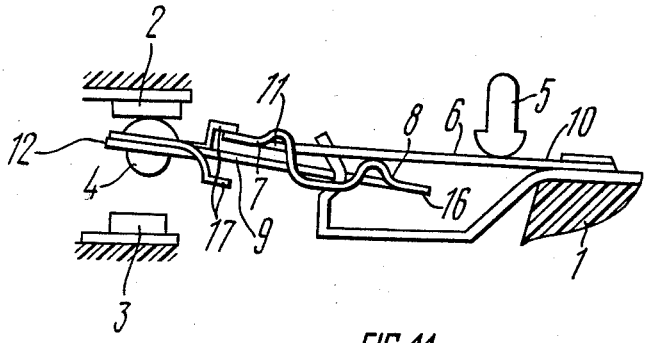
FIG. 11 is a general view showing a further modification of the microswitch of the invention.
Figure 12:
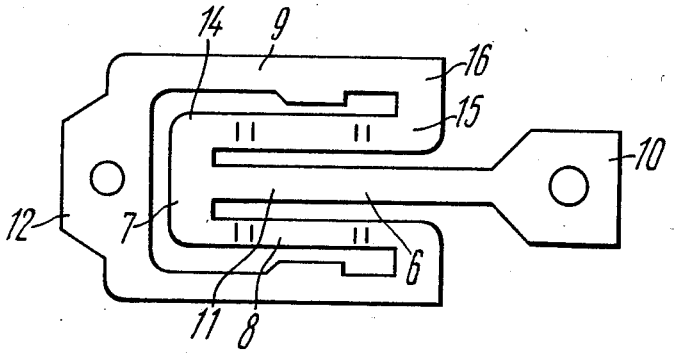
FIG. 12 is a top view of means for shifting the movable contacts.

In the initial position of the microswitch, the preliminarily compressed spring 8 exerts a force P upon the intermediate lever (see FIGS. 5–6).

The contact pressure $P_k$ consists of two components:

$$P_k = P_1 + P_3 \frac{<L_1}{L},$$

where $$P_1 = P;l \text{ in } \alpha$$

$$P_3 = P_2 \sin \beta$$

$\alpha$ is an angle of inclination between the intermediate lever 7 and the spring 8

$\beta$ is an angle of inclination between the spring 8 and the lever 9

$\Delta L_1$ is a horizontal projection of the length of the contact lever 9 from the point, O, of its connection with the insulating base 1 to the point of connection of the contact lever 9 with the flat spring 8

L is a horizontal projection of the length of the contact lever 9 from the point O to the end 12 on which the movable contact 4 is secured.

Under the action of the external force F, which reaches the value of $F_1$, the actuating lever 6 moves in the direction of this force, and the intermediate lever 7 changes its position and compresses the spring 8.

As the point A reaches the position $A_1$, the contact pressure is somewhat increased since the force P increases to the value of P′ (see FIG. 6) under the action of the compressed spring 8.

$$P_k = P_3 \frac{\Delta L_1}{L} \quad \frac{P_2' \sin\beta \Delta L_1}{L}$$

With further motion of the actuating lever 6 and with crossing the line I—I, the line of unstable position, by the point A, the shift of the movable contact 4 takes place at an inherent speed of motion.

The differential stroke of the actuating lever 6 at the point A (point of connection of the actuating and of the intermediate levers 6 and 7) is equal to the distance between the points $A_1$, $A_3$ (see FIG. 5).

$$L_A = \Delta h_2 + 2\Delta h_3$$

The stroke $\Delta h_2$ is found from the relation $$\frac{\Delta h_2}{\Delta L_1 + \Delta L_2} = \frac{H}{L}$$

Hence $$\Delta h_2 = \frac{H(\Delta L_1 + \Delta L_2)}{L},$$

where $\Delta L_2$ is a horizontal projection of the magnitude of the point A displacement.

The stroke $\Delta h_3$ is found from the relation $$\frac{h_3}{\frac{H}{2}} = \frac{\Delta L_2}{L}$$

Hence $$\Delta h_3 = \frac{H \Delta L_2}{2L}$$

Thus $$L_A = \frac{H(\Delta L_1 + \Delta L_2)}{L} + \frac{H_1' \Delta L_2}{L}$$

The differential stroke of the actuating link 6 at the point of application of the force F equals $$L_F = \left[ \frac{H(\Delta L_1 + \Delta L_2)}{L} + \frac{H_1 \Delta L_2}{L} \right] \cdot \frac{L_1}{L}, \quad (4)$$

where L and $L_1$ is a horizontal projection of the length of the actuating lever 6 and a horizontal projection of its portion from the point of application of the force F to the point of its connection on the insulating base 1.

Since in practice $\Delta L_1 \approx 0.1H$, $\Delta L_2 \approx 0.02L$, and $H_1 \approx 0.5H$, thus $L_A \approx 0.1H$.

Figure 4:
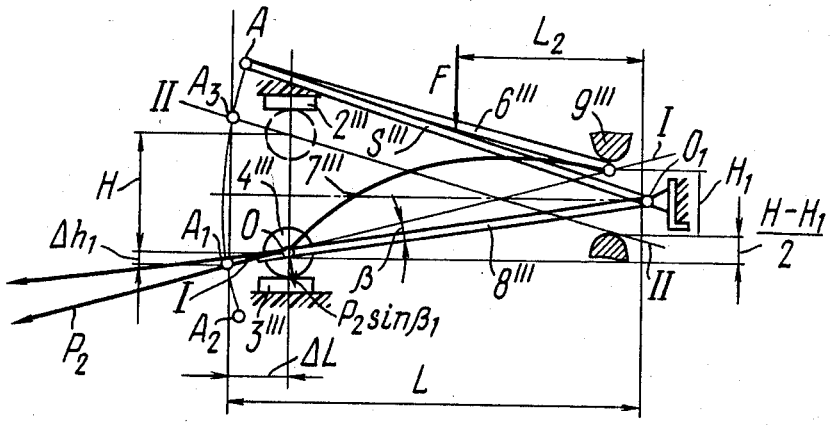
FIG. 4 PRIOR ART
FIG. 4 shows a mechanical diagram of one more prior art microswitch.

Therefore, the differential stroke of the actuating link in this microswitch, comparing the expressions (3) and (4), is approximately ten times smaller than in the prior art microswitch shown in FIG. 4.

We claim:

1. A microswitch comprising: an insulating base; fixed contacts secured on the insulating base; a movable contact adapted for selectively engaging the fixed contacts; and means for shifting the movable contact, which means include an actuating lever, an intermediate lever, a flat spring, and a contact lever all connected in series with one another, said actuating lever and said contact lever being secured to the insulating base so as to be able to turn at desired angles, the ends of said intermediate lever and of said flat spring being connected with one another and bearing against a limit stop, and said contact lever having a free end supporting said movable contact, characterized in that one end of said flat spring is connected with the end of said intermediate lever and bears against said limit stop located at the end of said contact lever supporting said movable contact, whereas the other end of said flat spring is connected with the other end of said contact lever lying opposite to said end carrying said movable contact, so that the fixation point of said contact lever on said insulating base is located between the two ends of said flat spring, while the point of connection of the end of said flat spring with the end of said contact lever is located between the point of connection of said actuating lever with said intermediate lever and the fixation point of said contact lever on said insulating base.

* * * * *